United States Patent [19]

Meyer

[11] Patent Number: 4,785,551

[45] Date of Patent: Nov. 22, 1988

[54] METHOD FOR DRYING CONFECTION PIECES

[75] Inventor: William J. Meyer, Prospect Heights, Ill.

[73] Assignee: Kraft, Inc., Glenview, Ill.

[21] Appl. No.: 55,433

[22] Filed: May 28, 1987

[51] Int. Cl.[4] ..... F26B 3/08; F26B 17/00

[52] U.S. Cl. ..... 34/10; 34/57 A

[58] Field of Search ..... 34/10, 57 A, 164

[56] References Cited

U.S. PATENT DOCUMENTS

| | | | |
|---|---|---|---|
| 2,370,825 | 3/1945 | Veit | 99/246 |
| 2,513,369 | 7/1950 | Shaw | 34/10 |
| 2,692,200 | 10/1954 | Olson | 99/103 |
| 2,876,557 | 3/1959 | Ducatteau | 34/57 |
| 3,063,848 | 11/1962 | Van Gelder | 99/204 |
| 3,216,344 | 11/1965 | Beagle | 99/237 |
| 3,511,843 | 5/1970 | Lewis | 260/291 |
| 3,572,235 | 3/1971 | Nutting et al. | 99/236 |
| 3,702,252 | 11/1972 | Veltman et al. | 99/23 |
| 3,900,958 | 8/1975 | Bongert et al. | 34/164 |
| 4,305,210 | 12/1981 | Christensen et al. | 34/164 |
| 4,306,359 | 12/1981 | Hoyt | 34/57 |
| 4,322,447 | 3/1982 | Hubbard | 426/467 |
| 4,657,767 | 4/1987 | Meade | 34/10 |
| 4,670,993 | 6/1987 | Dunaway | 34/164 |

OTHER PUBLICATIONS

Catalog No. 1149-3.5, entitled "Dryers and Coolers", published by Jeffrey Manufacturing Division, (copyright 1978).

Promotional Material: "Materials Processed", subtitled: Partial List of Materials Dried, Cooled or Processed by Lab or Production Units, (2 sheets).

*Primary Examiner*—Henry A. Bennet

*Attorney, Agent, or Firm*—Fitch, Even, Tabin & Flannery

[57] ABSTRACT

A method of drying a plurality of confection pieces, such as marshmallow bits, having a high volume density and outer surfaces which are adhesive at elevated temperature and moisture levels. A high volume density group of confection pieces at elevated moisture levels is heated while being fluidically transported with an air flow and while being vibrated until the moisture content thereof is reduced by one-half. The confection pieces are thereafter cooled with a cooler air flow, with the fluidized transport and vibration being continued throughout the cooling step.

12 Claims, 2 Drawing Sheets

METHOD FOR DRYING CONFECTION PIECES

BACKGROUND OF THE INVENTION

Figure 1:
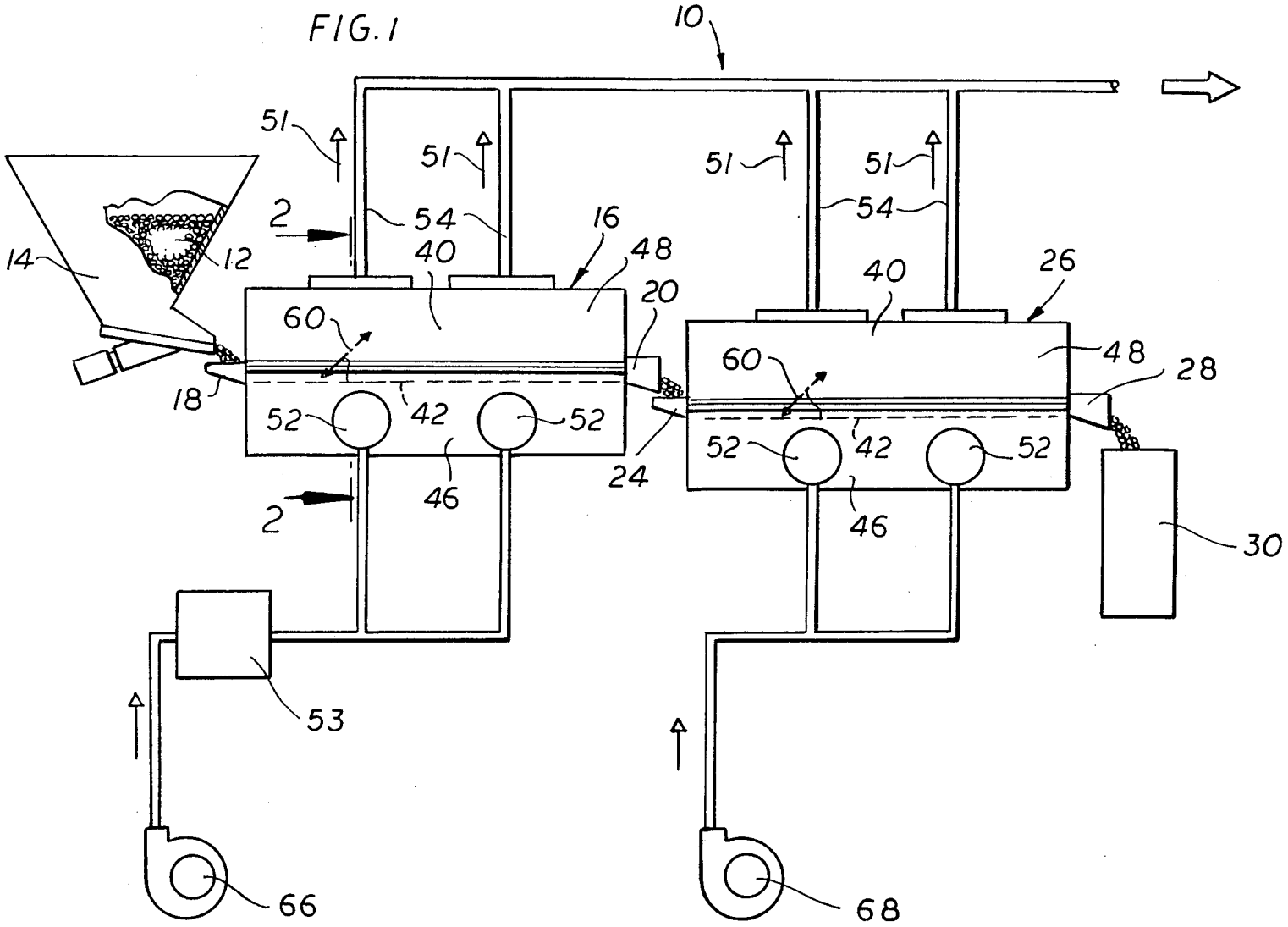

The present invention pertains to methods for drying confection pieces, and in particular to methods for drying confection pieces having outer surfaces which are adhesive at elevated temperature and moisture levels.

Aerated confection products, such as nougat, marshmallow and the like, have long been recognized for their unusual difficulty in drying, due to their easily deformable aerated structure, adhesive nature, the ease with which an adhesive bond is made upon contact with the confection product and the strength of the bond, particularly when the bond is formed between two confection pieces. The problems are, of course, aggravated by processing of smaller-size confection pieces having a high volume density.

Aerated confection products such as hard marshmallow bits, of the types used in breakfast cereals and the like, are typically extruded at temperatures above ambient temperature from an aerated syrup, in the form of ribbon-like strands The extruded ribbon-like strands of marshmallow have a relatively high moisture content which must be greatly reduced by drying. Unlike other marshmallow products, these bits are dried to lower moisture levels, to blend with the dry breakfast cereal, and are rehydrated when milk is added.

Prior to drying and cutting, the marshmallow strands are relatively soft and exhibit, even prior to heating, an adhesive or gummy surface. In order to facilitate conveying of the marshmallow strands to a cutting station and thereafter to a drying station, the extruded marshmallow strands are coated with starch to provide a barrier on their outer surface which reduces adhesive engagement with other marshmallow strands and with equipment such as conveyor belts, which they may contact. Further, as the marshmallow strands are cut into individual pieces or bits, the surfaces formed by cutting are coated with starch to prevent agglomeration among the bits, as well as adhesion to equipment which conveys or otherwise handles the marshmallow pieces. The marshmallow pieces are now ready for drying, the final step in their production.

Prior to the present invention, it was believed necessary to form an outer crust on the marshmallow pieces relatively slowly, and at relatively low but elevated temperatures, prior to heating those pieces to a higher temperature. The crust prevents pieces contacting each other from subsequently adhering to each other in an agglomerated mass, as the marshmallow outer surface is further softened and becomes even more adhesive as its temperature is raised. The crust-forming operation, as well as the subsequent drying operation at higher temperatures, is deliberately slow and relatively inefficient, requiring a considerable amount of floor space and large machinery for carrying out an extended, multistage drying process. Presently, the crust-forming operation requires a first production line in which the outer surfaces of the freshly cut marshmallow pieces are slowly dried on a conveyor belt at low temperatures. The major bulk of each marshmallow piece is relatively unaffected by the crust-forming operation, and accordingly, substantially the entire process of drying the marshmallow pieces must still be performed. To carry out the drying operation, the marshmallow pieces are transferred from the first production line to a second production line which uses a compartmented conveyor system for step-wise drying of the marshmallow pieces at successively higher drying temperatures. After drying, the marshmallow pieces are still relatively soft, unable to support an appreciable weight without a crushing deformation, and oftentimes a subsequent agglomeration occurs if contact is maintained long enough. Accordingly, the marshmallow bits are cooled.

Various arrangements for handling materials having a cohesive quality have been proposed. For example, U.S. Pat. No. 3,511,843 describes a fluidized bed conveyor for damp ground tobacco which fluidizes the tobacco material with steam. The arrangement employs mechanical agitation to avoid perforation of individual tobacco shreds by forming passages around pieces of the tobacco material for the conveying steam, without forcing the steam through fragments of the tobacco material. This patent is concerned with the transporting of tobacco material, using steam as the fluidizing gas and is not concerned with confection products or with the moisture content of the material conveyed.

Other fluidized gas arrangements have also been proposed. One arrangement, for example, is used to agglomerate coffee particles to produce larger-sized coffee "chunks." The arrangement introduces coffee particles into a fluidized bed which promotes cohesion of the coffee particles.

Accordingly, it is an object of the present invention to provide a method for drying and cooling aerated confection pieces, such as nougat, marshmallow bits and the like, in a bulk process, without causing agglomeration of those bits and while preventing adhesion of those bits to machinery which they may contact.

Yet another object of the present invention is to provide a method for drying and cooling marshmallow bits by imparting to those bits a plurality of different modes of movement throughout the drying cycle, with reduced processing times, while reducing the floor space and energy input previously required.

These and other objects and advantages of this invention will be apparent from the following detailed description and the accompanying drawings.

DRAWINGS

Figure 2:
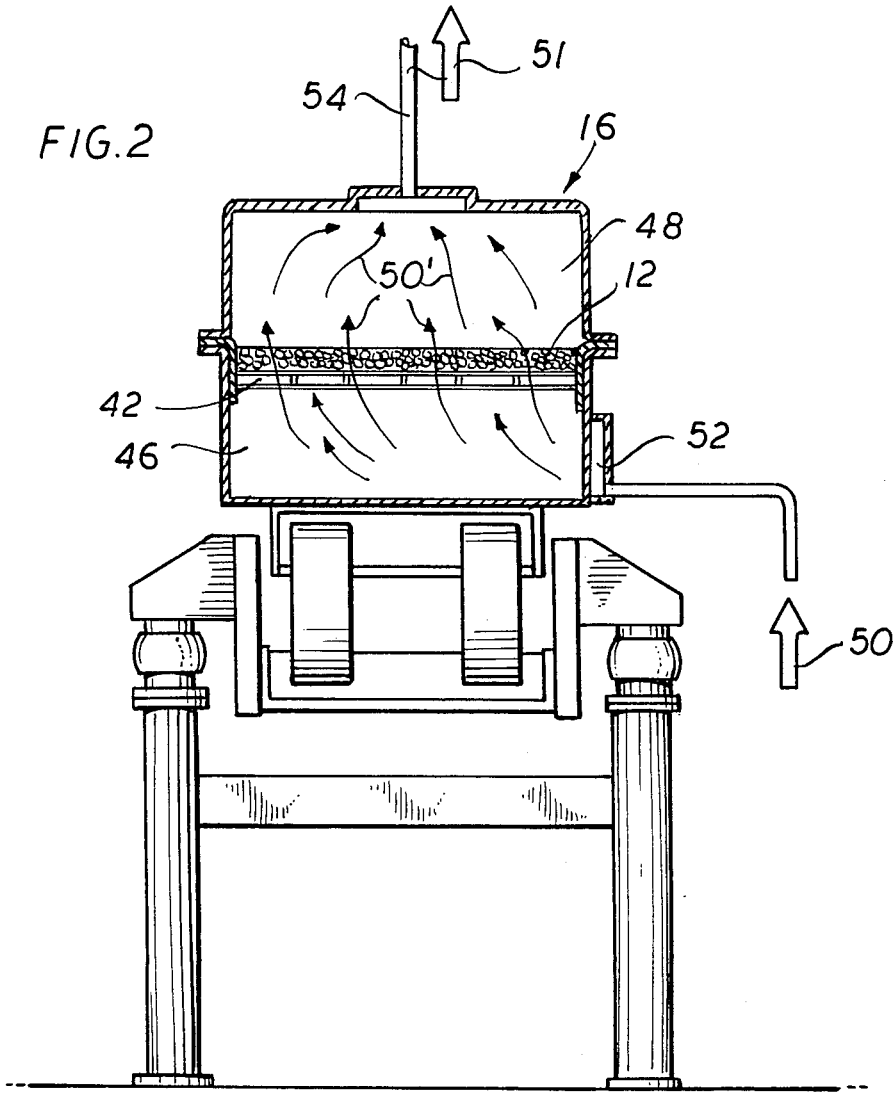

FIG. 1 is a schematic view of an apparatus for carrying out the method of the present invention; and FIG. 2 is a cross-sectional view of the apparatus taken along the lines 2—2 of FIG. 1.

SUMMARY OF THE INVENTION AND DESCRIPTION OF THE PREFERRED EMBODIMENT

Generally, in accordance with the present invention, methods are provided for the high volume density continuous drying and cooling of a plurality of confection pieces, the outer surfaces of which are adhesive at elevated temperatures and elevated moisture contents. Examples of such confections include marshmallow, nougat, and the like aerated confection products. Generally in accordance with such methods, a plurality of confection pieces are provided at an elevated moisture content and at a temperature below the elevated temperature. For example, this condition is found when extruding the confections from an aerated syrup. The confection pieces are immediately introduced to an elevated, relatively constant temperature drying step, after which they are automatically transferred to a correspondingly rapid cooling step which facilitates their ability to withstand the pressures experienced by being packed in a bulk container. Preferably, the temperature is abruptly raised to a single elevated temperature. During drying and cooling, the confection pieces are contacted (preferably continuously) with vibrating means such as a vibrating screen so as to impart a bouncing or vibrating motion thereto. The confection pieces are also suspended with air flow means, as the pieces are vibrated as they are heated and cooled. For example, a vibrating fluidized dryer-like apparatus may be used for cooling as well as heating. During heating, the air flow suspending the particles is heated to provide convenient heating of the particles. The particles may also be heated by a radiant heater. The pieces are vibrated and suspended with an air flow means until the moisture content thereof is reduced at least one-half.

It is believed that imparting elevated temperature and moisture levels to marshmallow material affects not only the solution properties of the marshmallow sugar content, but also affects the gelatin content of the marshmallow in a way which increases the adhesive nature of the gelatin component as well, thus further contributing to the adhesive nature of the outer marshmallow surface during drying and cooling. This is believed to be one reason why, unlike many other confection products, marshmallow, nougat, and other aerated confection pieces are particularly sticky, especially at elevated moisture and temperature levels, such as those experienced during drying and cooling of the product. Marshmallow pieces and the like have an aerated structure which is soft and easily deformed, thereby increasing their tendency to agglomerate and to adhere to processing equipment, since contact area is increased upon deformation. Further, during a drying process where the marshmallow bit is heated, moisture is driven off or is made to diffuse from the interior of the marshmallow bit to its outer surface, thereby continuously producing an adhesive quality at the outer surface of the marshmallow bit throughout its drying process, which extends beyond an initial drying stage were moisture not driven to the outer surface. Upon rapid heating, the rate of moisture flow of the outer surface is increased over that of slow heating, a condition which further aggravates the cohesive nature of the outer confection surface. It was not at all clear upon conducting initial tests for carrying out the present invention, that the conventional prolonged crust-forming operation could be altered. Generally, it was suspected that, even if the marshmallow could be successfully introduced into the first dryer stage, upon elevated heating they would agglomerate and/or adhere to the vibrating screen and walls of the funnel-like chutes and plenum chamber. In carrying out the method of the present invention, it was discovered that confection pieces, even marshmallow confection pieces, could be continuously dried with immediate contact to the most elevated drying temperatures, without consequent agglomeration or adhering to the drying equipment.

Turning now to the drawings, a preferred embodiment of an arrangement 10 for cooling and drying confection pieces 12 is illustrated as a two-stage unit. The confection pieces 12 are loaded into a hopper 14 for introduction into the inlet 18 of the first, drying unit or stage 16 where their moisture content is reduced to at least one-half of their original input level. At the exit 20 of drying stage 16, the confection pieces have reduced moisture content, but elevated temperature levels. According to one aspect of the present invention, the confection pieces 12 are then introduced into the inlet 24 of a cooling unit 26, where their temperature is reduced to a level which permits bulk packaging in a container 30. Confection pieces leaving the outlet 28 of cooling unit 26 have both moisture and temperature levels reduced.

The preferred embodiment is directed to the drying of marshmallow bits such as those that are typically formed by cutting extruded sticks or strands of marshmallow material. Marshmallow bits, like other confection pieces, have sugar on their outer surface. Due to the solution properties of sugar at elevated temperatures, even a very small amount of water or moisture causes sticking problems. In addition, marshmallow pieces, unlike many other confection products, have a gelatin component which, it is believed, contributes to the adhesive, sticky or tacky nature of marshmallow surfaces at either elevated temperatures or elevated moisture levels. Very severe problems of agglomeration among marshmallow pieces and their adhesion to conveyors, hoppers, and the like equipment, are experienced when both temperature and moisture levels are raised.

In a commercial process, marshmallow is formed by extrusion of an aerated syrup comprised of sugar, dextrose, gelatin, and other ingredients The outer surface of the extruded marshmallow strands or sticks are adhesive, especially at the relatively low extrusion temperatures, and accordingly are coated with starch to prevent their adhesion to conveying equipment, and especially to other sticks. Even at the relatively low extrusion temperatures, about 10° above ambient, the marshmallow sticks are so adhesive that they bond almost immediately upon contact with one another Accordingly, one expedient is to bring starch into contact with the outer marshmallow surface in any of a variety of ways, such as sprinkling starch on the strands, for example.

The method of the present invention is particularly useful for processing marshmallow bits of the types used in cereals and other food products. Unlike other marshmallow products, the marshmallow bits are significantly smaller and are intentionally dehydrated for storage with the cereal. In the preferred embodiment, the marshmallow strands from which the marshmallow bits are formed range between one-quarter and five-eighths inches in diameter, and accordingly have a substantial surface area for their volume. The strands are then fed to a cutting station having reciprocating blades, which cut the strands into pieces generally one-quarter inch to three-eighths inch in length. The cut edges are as highly adhesive as the extruded outer surface prior to coating, and accordingly they must be treated by being brought into contact with starch powder. Although the starch coating reduces the sticky nature of the outer surfaces, they are still highly adhesive, due principally to their elevated moisture content. The outer starch coating, however, allows the marshmallow pieces to come into contact with each other long enough to be fed through hopper 14, if feeding is done with a minimum of pressure exerted between marshmallow pieces. If the process is significantly delayed at this point, the marshmallow bits may become deflated, and in some instances, the outer starch coating may be absorbed into the marshmallow material, in which event the adhesive quality of the outer surface is virtually unabated. It has been found, in practicing the present invention, that the marshmallow bits referred to above can successfully withstand intermediate storage up to about six hours, but preferably less than about one hour without deflation or absorption of the outer starch coating. Upon introduction into arrangement 10, the marshmallow pieces have a temperature slightly above ambient, approximately 90° F., and an inlet moisture content of about 11%.

Although the present invention is illustrated with respect to aerated confections, other types of confection can benefit from the drying method of the present invention. In particular, the present invention allows the drying of adhesive or otherwise sticky bits of confection material without their agglomeration. Marshmallow as well as other aerated confection products, however, present unusually rigorous demands because, not only are their outer surfaces adhesive, but their internal structure is relatively soft and easily deformed, thereby increasing the likelihood of spontaneous adhesion between confection pieces brought into contact with each other.

Although confection products having adhesive surfaces can be dried if given special attention, such as maintaining the confection pieces separate from one another during the drying process, commercially practical processes must be carried out in a high-volume density mode, wherein a large number of confection pieces are piled together in groups having dimensions several times the dimension of the individual particle or piece. In a commercially practical environment, not only must the floor space for drying equipment be reduced to a minimum, but the production rates must also be increased in a manner which produces the most efficient utilization of capital equipment To provide these benefits, the present invention, in one of its aspects, imparts a levitation or pneumatic suspension motion as well as a bouncing or long-period vibrating motion to the confection pieces during both drying and cooling operations. The drying and cooling units 16, 26 are similar in construction FIG. 2 is a cross-sectional, schematic representation of the drying and cooling units of the preferred embodiment. The units include a plenum 40 with an internal screen 42 which divides the interior of the plenum into lower and upper sections 46, 48, respectively. The confection pieces 12, upon entry into plenum 40 from inlet 18, are supported on screen 42. Pressurized air, designated by arrow 50, flows into lower section 46 through inlets 52. Incoming air is heated in a heat exchanger 53. Preferably, the incoming air is heated to provide the required heating of the marshmallow bits, although the marshmallow can be heated directly, as by radiant heating units disposed in the upper portion 48 of plenum 40. As indicated by the arrows 50', the air flow is distributed uniformly by an arrangement of spaced rods forming a screen 42. The pressurized flow of air passes through the screen 42 and the layer of confection pieces 12 supported thereon.

According to one aspect of the present invention, the air flow is maintained at a velocity sufficient to levitate or pneumatically suspend the confection pieces above screen 42. The confection pieces undergo more of a pneumatic transport than a true fluidized bed suspension, as will be seen herein. The air velocity of the preferred embodiment ranges between 200 and 300 feet per minute, but preferably ranges between 270 and 300 feet per minute (fpm) to produce bed depths ranging between five-eighths and one and three-quarter inches, depending upon the size of the confection pieces and the feed rate. Generally, the confection pieces processed are of varying sizes and shapes, but all fit within a sphere ¾inches in diameter. The air flow 51 leaving the bed of confection pieces 12 exits plenum 40 at exhaust ducts 54. As mentioned above, similar units in the preferred embodiment are used for both drying and cooling. When used in the preferred embodiment for drying, inlet air temperature ranges between 200° F. and 300° F., but preferably is held at approximately 250° F., and at a velocity of about 300 fpm. The confection pieces are heated from an inlet temperature ranging between 70° F. and 110° F., but preferably, about 90° F. to a temperature ranging between 175° F. and 220° F. Moisture is preferably reduced at least one-half, from between about 8% and 12% to a level ranging between 1.3% and 3.5%. The confection pieces are preferably retained in the plenum for times ranging between 1.5 and 7 minutes, but preferably between 2.1 and 5.5 minutes.

When used as a cooling stage, inlet air is between 70° F. and 110° F., but preferably at ambient temperature, and has a flow rate ranging between 65 and 110 fpm. The confection pieces are suspended in a bed depth ranging between one-half and one inch, and are retained in the plenum for times ranging between 1.5 and 3.5 minutes. During these times, the confection pieces are cooled to near ambient temperatures, and preferably to temperatures no more than 20 degrees in excess of the cooling air inlet temperature.

According to another important aspect of the present invention, the pneumatic suspension of the confection pieces during their rapid, high temperature drying and subsequent cooling is generally to sufficient to prevent their agglomeration, and accordingly, additional bouncing or longer-period vibratory motion is imparted to the particles by the vibrating screen 42. In the preferred embodiment, the two stages 16, 26 were obtained from the Jeffrey Manufacturing Company of Columbus, Ohio. No model numbers were associated with the units, the units being identified simply as a "Jeffrey Vibrating Bed for rental dryer, size 12"×10'."

The vibration stroke of screen 42 ranges between one-eighth and one-sixteenth inch, depending upon bed depth and particle size. As will be seen, motor speed driving the screen 42 provides a practical adjustment for the retention time and desired motion of the fluidized confection pieces. Preferably, the motor is adjusted to provide a vibration rate ranging between 580 and 700 strokes per minute. It is believed that recently agglomerated masses of confection pieces, being heavier, fall through the fluidized confection pieces into contact with the vibrating screen 42, to become separated upon one or more contacts with the vibrating screen. Further, even separate confection pieces rebounding from the vibrating screen can transfer vibrational energy which tends to separate into agglomerated masses. The time duration of contact between confection pieces is believed to be an important factor of inter-particle adhesion strength, especially for the temperature and humidity regimes of interest. The "agglomerated masses" separated by the vibration are typically formed during the production process which is made as continuous as possible, with minimum time delays between extrusion and drying. Although the present invention also has application to agglomerated masses that have been formed for longer times, it should be recognized that the air flow and vibration values given below may not be sufficient to break all units or subunits of agglomerated masses.

Experiments were conducted employing the principles of the present invention. In the following Table 1, test results are summarized for the drying of six differently-sized and shaped marshmallow bits. The irregular shapes listed in the table comprise ornamental designs including irregular edge structures of interest to consumers. One important feature of the present invention is that the particular designs and especially the irregular edges thereof remain well-defined throughout drying and cooling of the marshmallow bits.

TABLE 1

Marshmallow Bit Drying Data

| Shape | Size Length/ Diameter in./in. | Inlet Air Temp. °F. | Avg. Bed Depth (Inch) | Prod. Moisture Init. (%) | Prod. Moisture Final % | Air Veloc. (FPM) | Vibration (RPM) |
|---|---|---|---|---|---|---|---|
| Irregular #1 | $\frac{1}{4} \times \frac{3}{8}$ | 250 | $\frac{5}{8}$ | 10.5 | 2.56 | 295 | 625 |
| Irregular #2 | $\frac{1}{4} \times \frac{1}{2}$ | 256 | 1 | 10.8 | 1.34 | 270 | 630 |
| Irregular #3 | $\frac{1}{4} \times \frac{1}{2}$ | 255 | $\frac{7}{8}$ | 10.8 | 3.09 | 315 | 615 |
| Cylinder | $\frac{1}{4} \times \frac{1}{4}$ | 250 | $1\frac{1}{4}$ | 10.5 | 2.62 | 295 | 625 |
| Cylinder | $\frac{3}{8} \times \frac{3}{8}$ | 252 | $1\frac{3}{4}$ | 10.8 | 3.28 | 250 | 610 |
| Irregular #4 | $\frac{1}{4} \times \frac{1}{2}$ | 255 | $1\frac{1}{2}$ | 10.5 | 2.43 | 275 | 615 |

| Shape | Size Length/ Diam. in./in. | Product Bulk Density lb./ft$^3$ | Product Temp. Inlet Temp. (°F.) | Product Temp. Exit Temp. (°F.) | Production Rate lb./min. | Retention Time Min.: Sec. |
|---|---|---|---|---|---|---|
| Irregular #1 | $\frac{1}{4} \times \frac{3}{8}$ | — | 85 | 185 | 3.2 | 2:15 |
| Irregular #2 | $\frac{1}{4} \times \frac{1}{2}$ | — | 90 | 205 | 2.3 | 5:45 |
| Irregular #3 | $\frac{1}{4} \times \frac{1}{2}$ | — | 90 | 180 | 3.5 | 2:45 |
| Cylinder | $\frac{1}{4} \times \frac{1}{4}$ | — | 85 | 185 | 4.4 | 3:30 |
| Cylinder | $\frac{3}{8} \times \frac{3}{8}$ | — | 90 | 195 | 4.0 | 5:05 |
| Irregular #4 | $\frac{1}{4} \times \frac{1}{2}$ | — | 90 | 210 | 3.6 | 5:30 |

Immediately after drying, the six groups of marshmallow bits were cooled using principles of the present invention. In the following Table 2, the cooling data is summarized for each different marshmallow shape and size.

TABLE 2

Marshmallow Bit Cooling Data

| Shape | Size Length/ Diameter in./in. | Inlet Air Temp. °F. | Avg. Bed Depth (Inch) | Prod. Moisture Init. (%) | Prod. Moisture Final % | Air Veloc. (FPM) | Vibration (RPM) |
|---|---|---|---|---|---|---|---|
| Irregular #1 | $\frac{1}{4} \times \frac{3}{8}$ | 80 | $\frac{7}{8}$ | 2.34 | 2.40 | 100 | 670 |
| Irregular #2 | $\frac{1}{4} \times \frac{1}{2}$ | 80 | $\frac{1}{2}$ | 1.93 | 2.28 | 100 | 670 |
| Irregular #3 | $\frac{1}{4} \times \frac{1}{2}$ | 80 | $\frac{5}{8}$ | 3.09 | 4.09 | 90 | 680 |
| Cylinder | $\frac{1}{4} \times \frac{1}{4}$ | 80 | $\frac{3}{4}$ | 4.09 | 4.31 | 70 | 685 |
| Cylinder | $\frac{3}{8} \times \frac{3}{8}$ | 80 | 1 | 3.00 | 3.34 | 75 | 685 |
| Irregular #4 | $\frac{1}{4} \times \frac{1}{2}$ | 80 | $\frac{3}{4}$ | 2.43 | 1.87 | 75 | 675 |

| Shape | Size Length/ Diam. in./in. | Product Bulk Density lb./ft$^3$ | Product Temp. Inlet Temp. (°F.) | Product Temp. Exit Temp. (°F.) | Production Rate lb./min. | Retention Time Min.: Sec. |
|---|---|---|---|---|---|---|
| Irregular #1 | $\frac{1}{4} \times \frac{3}{8}$ | 14 | 185 | 83 | 3.1 | 3:25 |
| Irregular #2 | $\frac{1}{4} \times \frac{1}{2}$ | 15 | 180 | 84 | 2.5 | 2:15 |
| Irregular #3 | $\frac{1}{4} \times \frac{1}{2}$ | 13.5 | 180 | 87 | 3.5 | 2:05 |
| Cylinder | $\frac{1}{4} \times \frac{1}{4}$ | 14.5 | 185 | 90 | 6.2 | 1:30 |
| Cylinder | $\frac{3}{8} \times \frac{3}{8}$ | 13.5 | 195 | 88 | 3.2 | 3:20 |
| Irregular #4 | $\frac{1}{4} \times \frac{1}{2}$ | 15.5 | 210 | 96 | 3.6 | 2:40 |

The Jeffrey Vibrating Bed Units used in the preferred embodiment, to obtain the above test data, employ an electric motor which vibrates screen 42 with an eccentric drive. The vibration can be adjusted by adjusting the stroke, or displacement of the screen, as well as the motor speed. The direction of stroke, or screen displacement, is indicated by arrows 60 of FIG. 1. Generally, the stroke is oriented at a 45° angle to the screen 42, being pointed in an upward, downstream direction but could be at any angle to regulate the upward and downstream components of motion. The stroke generally ranges between one-sixteenth and one-eighth inch, and preferably at values closer to one-sixteenth inch. This range of stroke produces a very wide range of retention times, greater than that needed for optimum drying performance. More precise, i.e., finer, control is obtained by varying the motor speed after the stroke is adjusted to obtain the approximate desired retention time in the upstream drying stage 16. Rather than employ a dam at the discharge of the conveying unit, which relies on an increased buoyancy of the confection pieces due to decreased weight, the preferred embodiment relies on the timing process inherent in the vibrating fluidized bed of the first and second stages. The confection pieces generally follow in sequential succession throughout the length of the drying and cooling stages, starting at inlet 18. Optimum retention times were empirically determined. The retention times varied most notably with inputted moisture content, but in general reflected a three to five-fold reduction in the drying times compared to the conventional multistage, extended belt drying apparatus, for the described ranges of marshmallow bit size and shapes. Unlike the previous technique, the present invention allows immediate contact of the confection pieces with the most elevated drying temperatures.

As mentioned above, it is significant that the confection pieces are vibrated as well as pneumatically transported through the drying and cooling units. According to early tentative theories, based upon trial runs, the bouncing or vibrational energy imparted to the confection pieces is more than a contribution to their overall kinetic energy. Rather, the specific impulsive nature of the bouncing or vibratory motion is believed to break joined agglomerated masses within a critical time before the bond between contacted confection pieces strengthens.

The final temperature of the confection pieces exiting the cooling stage 26 is important to allow the use of deeper storage containers 30 without causing deformation of confection pieces at the bottom of the container, subsequent to their drying and cooling. Accordingly, the preferred embodiment employs continuous sampling of the moisture and temperature levels of the confection pieces at the inputs and outputs of the drying and cooling stages 16, 26.

Several variations on the above-described arrangement are possible. For example, a higher air velocity would allow an increase in the bed loading or drying capacity per unit area, above the approximate loading of 22 lb./hour-square foot loading at a depth of 1.1 inches. It is expected that bed depth could be increased to 2 inches with a modest improvement in the air velocity. With such increases, and using the largest readily-available commercial units (approximately 6 feet wide by 25 feet long), a capacity of 4,000 lb./hour (or 27 lb./hour-square foot) is obtainable. Although, as mentioned above, the two units 16, 26 used in the preferred embodiment are substantially identical, the cooling stage can be made smaller. For example, a cooling stage of a 50 foot square working area may be used to cool confection products from 185° F. to 90° F., when combined with a heating stage of larger bed size (approximately 6 feet by 25 feet). For example, if cooling to 115° F. rather than 90° F., the cooling stage need only have 25 square feet of working area. Compared to conventional apparatus employed today, this amounts to a 75% reduction in dryer area and a 50% reduction in cooling area, assuming cooling to 90° F. Although only forced air pressure fans 66, 68 are shown, a balanced design air handling system can be utilized to produce an induced draft on the exhaust side of each stage 16, 26 in addition to the forced draft at the inlet side to each stage. The balanced air handling system is of particular advantage when drying marshmallow confection pieces, in that it promotes conservation of starch material which comes loose during the drying and cooling steps.

Rather than use a screen mesh, a screen-like conveying surface formed of an array of rods is preferred. For example, rod spacing in the upstream drying stage is held at 0.01 inches, whereas rod spacing in the lower, cooling stage is held at 0.03 inches. The selection of rod spacing was found to assure uniform air distribution, which is necessary to provide optimum particle fluidization.

A variety of vibration control techniques can be employed. Preferably, as indicated above, the mechanical vibration of the screen or rod arrangement 42 is controlled by varying the speed of the motor, and the quantity of rotating weights associated with the eccentric drive. The proportion of vertical to horizontal movement is fixed at unity, a feature associated with the 45° orientation of the stroke, relative to the screen or rod array.

Further, although elevated drying temperatures approaching 250° F. were employed in the test, and are reflected in the test data, higher drying temperatures, and even significantly higher temperatures, are possible. The test data of Tables 1 and 2 was obtained using dryer inlet air of 15% relative humidity, measured at 80° F. It is possible to further reduce the drying times and increase the bed capacity by using dryer inlet air.

The method according to the present invention provides significant reductions in drying times. Under the above-described prior art methods, wherein temperatures are gradually stepped up to 180° F. using two compartmented conveyers, drying times alone typically took 45 minutes. The present invention accomplishes the same drying in only five minutes, and similar rates are easily attainable using much smaller commercially available equipment.

Other arrangements for heating the confection pieces, other than heating the fluidizing air flow 50, are possible. For example, radiant or sensible heating can be employed within the plenum 40 using heating lamps, heating wires, or the like. However, care must be taken to avoid collapse of the confection product on exposure to the sensible heat. This is especially critical in aerated products, such as marshmallow and nougat, and the above-described aspects of the present invention are particularly important in avoiding collapse.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A method of drying a plurality of aerated, gelatinized confection pieces, the outer surfaces of which are adhesive at elevated temperatures and elevated moisture contents, comprising:

providing a plurality of confection pieces at an elevated moisture content and at a temperature below said elevated temperature;

heating said confection pieces to said elevated temperature;

contacting said confection pieces with a vibrating surface as said pieces are heated so as to impart a repetitive bouncing motion thereto;

forming a fluidized bed of said confection pieces with an air flow as said pieces are heated and repetitively bounced with said vibrating surface; and maintaining said pieces at said elevated temperature while repetitively bouncing said pieces with said vibrating surface and confining said pieces to the fluidized bed until said moisture content thereof is reduced at least one-half.

2. The method of claim 1 wherein the step of heating said confection pieces comprises the step of heating the air of said air flow.

3. The method of claim 1 further comprising the step of cooling said confection pieces after heating, said cooling step comprising the steps of:

repetitively bouncing said confection pieces with a vibrating surface as said pieces are cooled;

reducing the temperature of the air of said air flow to a temperature less than that of said elevated temperature; and maintaining the movement of said pieces with said vibrating surface and said air flow until said confection pieces are cooled to a desired exit temperature.

4. The method of claim 2 wherein said confection pieces comprise marshmallow bits sized to fit within a sphere ¾ inches in diameter and the air of said air flow is heated to a temperature ranging between 200 and 300 degrees Fahrenheit.

5. The method of claim 4 wherein the air of said air flow means has a velocity ranging between 200 and 300 feet per minute.

6. The method of claim 4 wherein said marshmallow pieces have an initial moisture content ranging between 8 and 12 percent and an initial temperature ranging between 70 and 100 degrees Fahrenheit.

7. The method of claim 3 wherein the temperature of the air of said air flow during said cooling step ranges between 70 and 90 degrees Fahrenheit, and the velocity of said air flow ranges between 65 and 110 feet per minute.

8. The method of claim 7 wherein said confection pieces are cooled for a time ranging between one and four minutes to reduce the temperature of the confection pieces to a temperature not more than 20 degrees Fahrenheit in excess of the temperature of the air of the air flow.

9. The method of claim 2 wherein said confection pieces are heated for a time ranging between 2 and 6 minutes to raise the temperature of the marshmallow pieces to a temperature ranging between 175 and 220 degrees Fahrenheit.

10. The method of claim 1 wherein the step of contacting said confection pieces with a vibrating surface comprises the step of contacting said confection pieces with a vibrating screen which is vibrated with a stroke ranging between 1/16 inch and ⅛ inch at a vibration rate ranging between 580 and 700 strokes per minute.

11. A method of drying a plurality of confection pieces, the outer surfaces of which are adhesive at elevated temperatures and elevated moisture contents, comprising:

providing a plurality of confection pieces at an elevated moisture content and at a temperature below said elevated temperature;

providing a first zone for treating said confection pieces;

introducing said confection pieces into said first zone;

heating said confection pieces to said elevated temperature in said first zone;

contacting said confection pieces in said first zone with a vibrating surface as said pieces are heated so as to impart a repetitive bouncing motion thereto;

confining a fluidized bed of said confection pieces in said first zone with an air flow as said pieces are heated and repetitively bounced with said vibrating surface;

maintaining said pieces in said first zone at an elevated temperature for a first preselected time period while repetitively bouncing said pieces with said vibrating surface and confining said pieces to the fluidized bed until said moisture content thereof is reduced at least one-half;

providing a second zone for treating said confection pieces;

transferring said confection pieces from said first zone to said second zone;

cooling said confection pieces in said second zone;

contacting said confection pieces in said second zone with said vibrating surface as said pieces are cooled so as to impart a repetitive bouncing motion thereto;

forming a fluidized bed of said confection pieces in said second zone with an air flow as said pieces are cooled and repetitively bounced with said vibrating surface; and maintaining said confection pieces in said second zone for another preselected time period while repetitively bouncing said pieces with said vibrating surface and confining said pieces to the fluidized bed until the temperature of said confection pieces is substantially reduced below that of said elevated temperature.

12. The method of claim 11 wherein said confection pieces are sized to fit within a sphere ¾ inches in diameter and have an initial moisture content ranging between 8 and 12 percent, the temperature in said first zone ranges between 200 and 300 degrees Fahrenheit during at least a portion of the residence time of the confection pieces therein, and the temperature in said second zone during at least a portion of the residence time of the confection pieces therein ranges between 70 and 90 degrees Fahrenheit.

* * * * *